US005106093A

United States Patent [19]

Engel

[11] Patent Number: 5,106,093

[45] Date of Patent: Apr. 21, 1992

[54] PUZZLE AMUSEMENT DEVICE

[76] Inventor: Douglas A. Engel, 2935 W. Chenango, Englewood, Colo. 80110

[21] Appl. No.: 638,564

[22] Filed: Jan. 7, 1991

[51] Int. Cl.[5] ..... A63H 33/08

[52] U.S. Cl. ..... 273/160; 446/120; 446/124

[58] Field of Search ..... 273/156, 157 R, 160; 446/86, 101, 116, 119, 120, 121, 124, 125

[56] References Cited

U.S. PATENT DOCUMENTS

| | | | |
|---|---|---|---|
| 3,389,493 | 6/1968 | Zysset | 446/124 |
| 4,932,916 | 6/1990 | Bliekle | 446/124 |
| 5,000,713 | 3/1991 | Cheng | 446/120 |

FOREIGN PATENT DOCUMENTS

| | | | |
|---|---|---|---|
| 2840204 | 3/1980 | Fed. Rep. of Germany | 446/124 |
| 1311992 | 11/1962 | France | 446/120 |

*Primary Examiner*—Edward M. Coven
*Assistant Examiner*—William M. Pierce

[57] ABSTRACT

A puzzle is comprised of cubically shaped pieces having 5 square holes centered on 5 of the cube faces and 1 square protrusion on the center of the sixth face. The protrusion is fitted with a spring loaded cog or catch so that the protrusion may be inserted into a square hole of another piece and will lock in place. The locked piece may be released only by inserting another piece in the correct orientation in another square hole in the same piece the first piece was inserted in. The release is effected by pressing the secondly inserted piece in all the way thereby releasing the catch of the first inserted piece but not allowing the release of the catch of the secondly inserted piece.

6 Claims, 1 Drawing Sheet

FIG.4
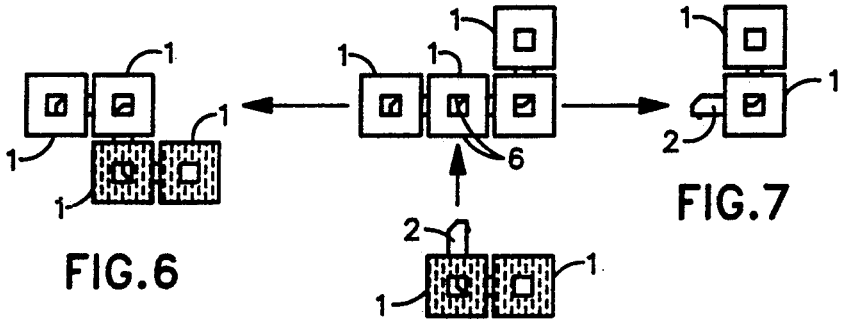
FIG.6
FIG.7
FIG.5
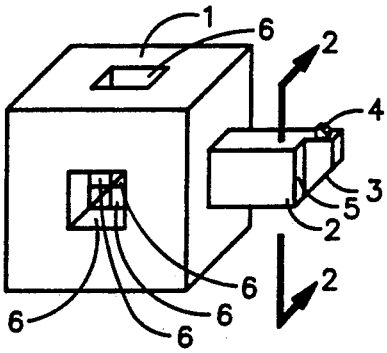
FIG.1
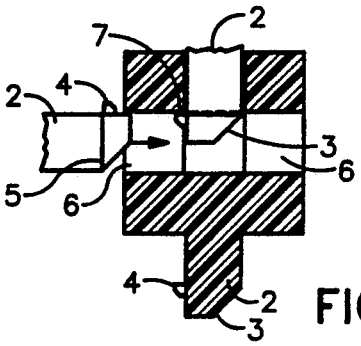
FIG.2
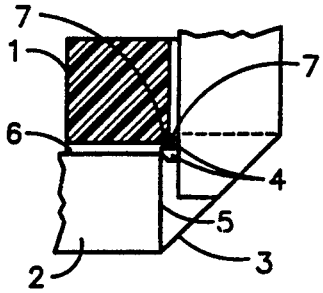
FIG.3
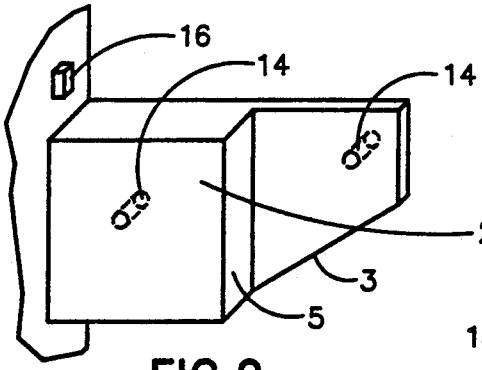
FIG.9
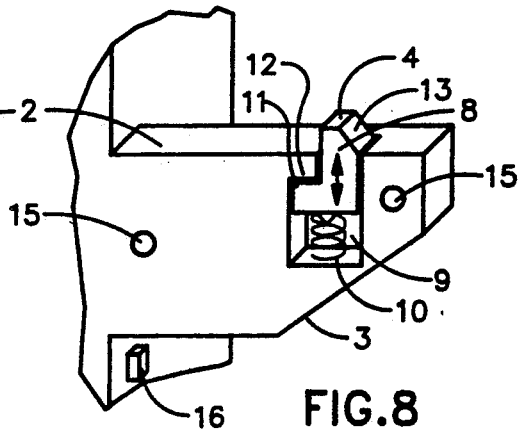
FIG.8

PUZZLE AMUSEMENT DEVICE

BACKGROUND OF THE INVENTION

1. Field of the Invention

The present invention relates generally to puzzles and games. More specifically, the present invention relates to a puzzle or amusement device incorporating cubical pieces constructed in such a manner that one piece may be inserted into another by means of a protruding locking mechanism. The cubical pieces are provided with square holes on the center of 5 faces and have a square locking protrusion extending from the center of the 6th face. When the locking protrusion is inserted into a hole of a like piece it becomes locked in place and cannot be removed. By inserting another piece into the same piece the first piece was inserted into it is possible to remove the first piece or the 2nd piece, but not both simultaneously, from the piece that each of the 2 pieces were inserted into. In the present embodiment such selective unlocking only occurs if the 2 inserted pieces are inserted at right angles to one another and the locking protrusions are correctly oriented so that their respective release mechanisms can be selectively activated by pushing in the piece not being released and pulling out the piece being released.

2. Brief Description of the Prior Art

Prior inventions relate to structures such as Rubik's cube and the 15 puzzle invented by Sam Loyd and to various locking puzzles. The present invention presents a new challenge by allowing independent clusters of pieces to be completely separated from one another yet a full solution requires the independent locked structures to be combined and recombined to finally arrive at an overall solution of one or more shapes incorporating all the pieces of the puzzle. In addition it is possible to color or mark the faces and require the solution to present matching or other combinations of the colors or marks. Pieces should always be inserted so that at least one other piece can be released but in case of a mistake a piece can be released with the aid of a pencil or small rod.

OBJECTS AND SUMMARY OF THE INVENTION

It is the principle object of the present invention to provide a device consisting of pieces made to lock together by means of holes and protrusions which are made to fit in the holes of similar pieces and the protrusions are fitted with locking cogs or catches that cause the pieces to become locked together and to be selectively released by pushing in similarly locked adjacent pieces so that by repeatedly locking and releasing pieces independent clusters or groups of locked pieces can be combined and recombined to finally realize a final form or shape or combination of forms and shapes which represents a solution or sought after combination of the locked 1 or more clusters of pieces. In addition by providing some of the pieces with 6 square holes instead of locking protrusion the solution will not present any of the protrusions but appear nicely configured without protrusions. Pieces can then be unlocked from the solved configuration because some of the pieces were locked in such a manner to allow release of other pieces.

BRIEF DESCRIPTION OF THE DRAWINGS

FIG. 1 is a pictorial view of a single piece with 5 square holes and 1 square locking and releasing protrusion.

FIG. 2 is a section showing how a pair of pieces can have their locking and releasing protrusions inserted into another piece.

FIG. 3 is a pictorial section showing the small locking cogs in locked position against the internal part formed by the square section where 2 holes meet in the piece the 2 other pieces were inserted into.

FIG. 4 shows a cluster of 4 locked pieces with no protrusions because it contains one piece with 6 square holes and no protrusions.

FIG. 5 shows a cluster of 2 such pieces.

FIG. 6 and FIG. 7 show the results of locking the clusters of FIG. 4 and 5 together allowing 2 new clusters to be released as shown by the large arrows.

FIG. 8 and FIG. 9 show a pictorial view of a method of manufacture by sectioning slightly off center of the plane cutting through the centers of 4 faces and through the protrusion. Each portion may then be snapped together by means of included pins and matching holes.

DESCRIPTION OF THE PREFERRED EMBODIMENTS

The basic structural elements of the invention are a main cubical piece 1 with square holes 6 on five of its faces. The sixth face is provided with a square protrusion 2 additionally fitted with an angled projection 3 containing a spring actuated locking cog 4 and a releasing surface 5 for pushing against the locking cog of another piece. These elements are shown pictorially in FIG. 1 and the working of the locking and releasing mechanism is depicted in FIG. 2 and in FIG. 3. In FIG. 2 the locking cog 4 of a partial piece is shown locked against the square section 7 inside a piece in which it has been inserted In addition another partial piece is shown being inserted in square hole 6 at right angles to the first piece. The angled ends 3 can be made small enough so that when correctly inserted two other pieces can be inserted and selectively released so that a single cubical piece might have four pieces locked onto it at once. In FIG. 3 both partial pieces are shown with their protrusions 2 fully inserted in holes 6 in the third partial piece and the action of the releasing mechanism can be seen to work by pushing the flat surface 5 of the other piece against the spring loaded locking cog 4 thus allowing the other piece to be removed but not allowing the pressed in piece to be simultaneously removed. In FIG. 4 a locked cluster of 4 pieces is shown. No additional protrusions are shown in FIG. 4 because one piece is a piece with no protrusion or has its protrusion facing downwardly. FIG. 5 shows a cluster of 2 locked pieces 1 ready to have one protrusion 2 inserted into a square hole 6 of the cluster in FIG. 4. FIG. 6 shows a locked cluster of 4 pieces allowed by the release of a cluster of two pieces in FIG. 7 when the cluster of two pieces in FIG. 5 was inserted in the cluster of four pieces in FIG. 4. FIG. 8 and FIG. 9 show a partial section taken slightly off set from the plane passing through 4 centers of four of the faces of the cubical piece of FIG. 1, where one of the faces contains the protrusion 2. FIG. 9 also shows a detail of the locking cog 4 fitted with a retaining end 11 and retained by a ledge 12 and held in place for locking actuation by spring 10 in a receptacle 9. The locking cog has an angled portion 13 which allows easy insertion into a square hole 6 in a piece in which it is to be locked. FIG. 9 shows the top part of the section of FIG. 8 fitted with pins 14 so that it will snap into holes 15 provided as shown in FIG. 8 and FIG. 9. This would allow for easy and rapid manufacture of the pieces. Small pieces of rubber or other elastic material 16 shown in FIG. 8 and FIG. 9 can be attached or fitted to the face having the protrusion to hold the pieces in alignment with the locking catches against the pieces they are locked to and to provide a positive locking and release action.

While completed solutions of the puzzle are not shown some preferred configurations can easily be described. A puzzle sold in eight pieces would require the formation of a single locked cluster to form a 2 by 2 by 2 cube of pieces One of the eight pieces would have 6 square holes and no protrusion to make an attractively completed puzzle. The faces of the puzzle would each be a different color to create an even more challenging puzzle. Another preferred configuration would have 27 pieces with 1, 2, 3, 4, 5 or 6 of the pieces having 6 square holes and no protrusions. This would allow independent configurations of completed groups or clusters of pieces which would then be placed together to form the completed 3 by 3 by 3 cube of pieces Each of the six faces of the completed cube could be a different color to make a very challenging puzzle. Although this invention has been described according to preferred embodiments and applications it will be appreciated that many variations and modifications and applications of the invention may be constructed. In particular tetrahedrons and octahedrons can be fitted with triangular holes and protrusions with catches to allow locked arrangements as solutions using these as pieces. Many other shapes can be used such as planar arrangements of square shapes having only three holes and one protrusion or equilateral triangles with two holes and one protrusion. In addition pieces can be fitted with more than one locking protrusion for other interesting embodiments of the puzzle. The spirit and intent of the puzzle would remain the same in all these additional applications.

What is claimed is:

1. A puzzle comprising cubical shaped pieces with square holes on a center of 5 faces of said pieces and a square locking and releasing protrusion fitted with a locking cog or catch and with a releasing surface and said locking and releasing protrusion extending from a center of a 6th face such that said locking and releasing protrusion can be snugly inserted into one of the square holes of another cubical piece and said releasing surface thereby allowing the release of a like piece by pressing the releasing surface of the releasing piece against the cog or catch of the piece to be released which said piece was already previously locked by its protrusion and cog or catch into a square hole of the said piece that both pieces are simultaneously locked into but not allowing the simultaneous release of the said releasing piece although once inserted either of the 2 said locked pieces might be removed but both could not be simultaneously removed.

2. The invention claimed in claim 1 wherein the pieces are not cubical but are a combination of 1 or more other geometric forms that allow desired arrangements of clusters or groups of said pieces and where the holes and protrusions have sections with triangular shapes.

3. The invention claimed in claim 1 wherein the pieces are not cubical but are thin and square and have only 3 holes and 1 protrusion fitted around one ore more edges of the said square shape.

4. The invention claimed in claim 1 wherein the pieces are not cubical but are thin and triangular and have only 2 holes and 1 protrusion fitted around one or more edges of the said triangular shape.

5. The invention claimed in claim 1 wherein the pieces are fitted with 2 or more said protrusions with said locking cogs or catches in addition to a smaller number of said holes in which the said protrusions may snugly fit and lock.

6. The invention claimed in claim 1 wherein the faces of said pieces having said protrusions have 1 or more small pieces of rubber or elastic material attached to cause the said pieces to maintain alignment with one another when locked together and allow for positive locking and releasing action.

* * * * *